US007234276B2

(12) United States Patent
Coberly

(10) Patent No.: US 7,234,276 B2
(45) Date of Patent: Jun. 26, 2007

(54) PORTHOLE APPARATUS AND METHOD OF INSTALLATION

(76) Inventor: Doug Coberly, 4605 S. Orange Blossom Trail, Kissimmee, FL (US) 34746

( * ) Notice: Subject to any disclaimer, the term of this patent is extended or adjusted under 35 U.S.C. 154(b) by 36 days.

(21) Appl. No.: 11/282,292

(22) Filed: Nov. 18, 2005

(65) Prior Publication Data

US 2006/0132376 A1 Jun. 22, 2006

Related U.S. Application Data

(60) Provisional application No. 60/629,400, filed on Nov. 18, 2004.

(51) Int. Cl.
*E04H 1/12* (2006.01)

(52) U.S. Cl. ..... 52/79.1; 52/265; 52/268; 52/745.05; 52/79.1; 52/79.7; 52/79.9

(58) Field of Classification Search ..... 52/79.1, 52/79.9, 265, 268, 745.05, 143, 68
See application file for complete search history.

(56) References Cited

U.S. PATENT DOCUMENTS 5,755,062 A * 5/1998 Slater ..... 52/79.1
6,026,975 A * 2/2000 Slater ..... 220/565
6,910,427 B2 * 6/2005 Woodall et al. ..... 105/358

OTHER PUBLICATIONS

Coberly et al; Standard Operating Procedure for Installation of Portholes in Monopoles, B&C Contracting Company (complete document), no date available.

* cited by examiner

*Primary Examiner*—Tho Phan
*Assistant Examiner*—Chuc Tran
(74) *Attorney, Agent, or Firm*—McHale & Slavin, P.A.

(57) ABSTRACT

The instant invention is a metallic device or porthole for use with communication antenna supporting structure, such as monopoles. The porthole of the instant invention includes an integrally connected backing bar that following the method of installation meets proper welding requirements.

7 Claims, 3 Drawing Sheets

PORTHOLE APPARATUS AND METHOD OF INSTALLATION

CROSS REFERENCE TO RELATED APPLICATION

This application is based upon provisional patent application No. 60/629,400, filed Nov. 18, 2004, the contents of which are herein incorporated by reference.

FIELD OF THE INVENTION

This invention is directed towards a metallic device useful for providing access to the interior of a communications support structure; particularly towards a porthole assembly and method for installing the same, to provide access to the interior of communication antenna supporting structures, while maintaining the structural integrity of the support structure.

BACKGROUND OF THE INVENTION

Beginning during the mid-1980's wireless communication carriers began installing self-standing communication antenna support structures designed and authorized for their own specified usage. However, due to the auctioning of the available radio spectrum by the Federal Communication Commission in 1994, the demand for viable communication antenna support structures has exploded.

The proliferation of these unsightly support structures has incited much public opposition to any new support structure construction. Beginning in the mid-1990's communities began enacting stricter zone requirements designed to stop additional installations of these communication antenna support structures (e.g. monopoles). This, in turn, has forced the wireless industry in the United States to "co-locate" or share the same communication antenna support structures, that is, multiple carriers now lease or purchase positions on existing monopoles.

In order to fit the needs of multiple carriers, thousands of these monopoles must be modified or retrofit to support the additional antennas. A typical monopole is made of a hollow, steel pole anchored to a foundation and whose interior is constructed and arranged for safely routing the communication cables to and from the various antenna located approximate the top. The addition of new carriers to a monopole is but one reason for the creation of openings by qualified welders within the monopole support walls. These openings are designed to provide access into the monopole's interior.

As would be expected, these crude openings compromise the structural integrity of the monopole walls, thereby requiring additional structural support by way of metallic devices (also known as portholes or access ports) sized to completely penetrate the crude opening. Once situated within the crude opening of the monopole, the porthole must be welded in place by a qualified welder using the necessary welding techniques, as set forth in the structural welding code set forth in the American Welding Society (AWS) D1.1 General Requirements. If installed properly, the porthole will lend the necessary structural support to the opening.

To this point porthole installation has been mostly unregulated, leading to numerous problems including installation hazards which result in the diminished structural integrity of the monopole. For example, currently during the installation of commercially available portholes the worker must cut the crude opening into the monopole and place an appropriately sized porthole within the crude opening. Next, the worker permanently adheres the porthole to the opening by weld reinforcement. The worker must weld a filler metal into the joint (i.e., distance between the surface of the monopole and the porthole). Typically, the welding occurs along the outside surface of the monopole, resulting in what is referred to as "partial joint penetration" (PJP). In a partial joint penetration weld the weld metal does not extend the entire distance as measured from the weld face into the joint. This creates in a weldment that does not meet proper welding specifications as defined by the AWS.

The conscientious worker will then have enter inside the cramped interior of the monopole and perform another back weld between the porthole and the inner surface of the monopole. Again, this can result in an undesirable partial joint penetration weld.

All debris inside the monopole should be removed and disposed of prior to any welding. Failure to inspect the interior of a monopole for debris (e.g., vegetation, animals, paper, fuel, etc.) has resulted in fires within the monopole, which ultimately destroy the monopole structure and the equipment therein.

Currently, inspection of the monopole interior involves the use of a flash light and mirrors. The instant inventor has developed a camera system which may be inserted into the interior of the monopole to readily identify potential fire and safety hazards, for example, debris that might ignite from contact with molten meal or spatter created by the welding process.

Thus, what has been heretofore lacking in the art is a porthole apparatus having an internally connected backing plate and a method of installing the same.

RELATED PRIOR ART

"Standard Operating and Quality Assurance Procedure for the Installation of Portholes in Monopoles" by Doug Coberley, (January 2005), is herein incorporated by reference in its entirety.

SUMMARY OF THE INVENTION

The present invention is directed toward a metallic device useful for providing structural integrity to a crude metallic opening penetrating a wall of a communications supporting structure (i.e., monopole). The crude opening having an axis of penetration therethrough. The metallic device comprising at least one crude opening penetrating wall having dimensions approximate to and less than the crude opening and adapted for insertion along the axis of penetration. The device further includes at least one backing bar disposed perpendicularly with respect to the penetrating wall and adapted to be positioned in overlapping and juxtaposed relation to the crude opening.

The penetrating wall and backing bar cooperate with the crude metallic opening to enable formation of a complete joint penetration weld.

Accordingly, it is a primary objective of the instant invention to provide a pre-assembled porthole having a backing bar that will permit the worker to readily achieve complete joint penetration, such that the weld metal extends through the joint thickness and the porthole installation is conformance with AWS D1.1 code.

It is yet another objective of the instant invention to provide a pre-assembled porthole apparatus wherein the backing bar is attached to the porthole at an off-site assembly facility eliminating the need for a welder with multiple welding procedure specifications (WPS) certifications, one WPS for welding the backer bar to the porthole and another WPS for welding the porthole to the monopole, thereby reducing porthole installation cost and time.

It is a further objective of the instant invention to provide a method of installing a porthole with a back plate that eliminates the need for the worker and welding equipment to enter inside the monopole to establish the proper weld reinforcement.

It is a still further objective of the invention to provide a method of installation wherein a remote camera system designed for viewing inside the monopole to identify potential fire and safety hazards, for example, debris that might ignite from contact with molten meal or spatter created by the welding process.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DEFINITIONS

The following list defines terms and phrases used throughout the instant specification. Although the terms, phrases, and abbreviations are listed in the singular tense the definitions are intended to encompass all grammatical forms.

As used herein, the phase "joint penetration" refers to the distance the weld metal extends from the weld face into a joint, exclusive of weld reinforcement.

As used herein, the acronym "AWS" refers to the American Welding Society (located at Miami, Fla., USA).

As used herein, the phase "complete joint penetration" or "CJP" refers to a groove weld in which weld metal extend through the joint thickness.

As used herein, the phase "partial joint penetration" or "PJP" refers to a groove weld in which incomplete joint penetration exists.

The phase "pWPS" refers to Prequalified Welding Procedure Specification. This document is an AWS prequalified welding procedure specification and should be the first document required of all contractors. This document provides the required welding variables for a specific application to assure repeatability by properly trained welders and welding operators. Prequalification of a WPS can be found in AWS D1.1 section 3.

The phase "WPS" refers to Welding Procedure Specification. This document is generated after you have qualified a PQR and is a proprietary procedure to the developing party and is not to be copied or used by other. If anyone else uses the procedure they are not in compliance with AWS D1.1 and may be subject to legal action.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to various employ the present invention in virtually any appropriately detailed structure.

Figure 1:
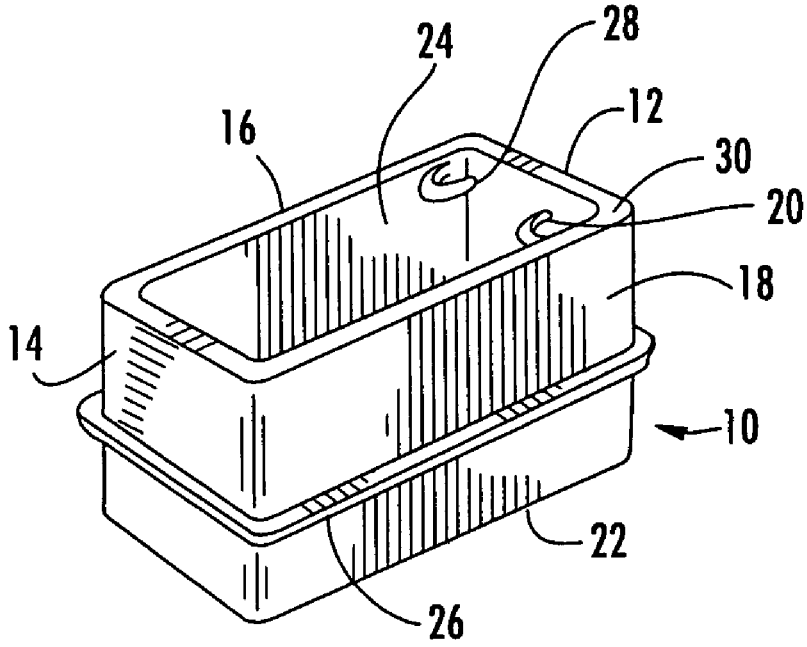
FIG. 1 is an elevated corner perspective view of the porthole of the instant invention.
Figure 4:
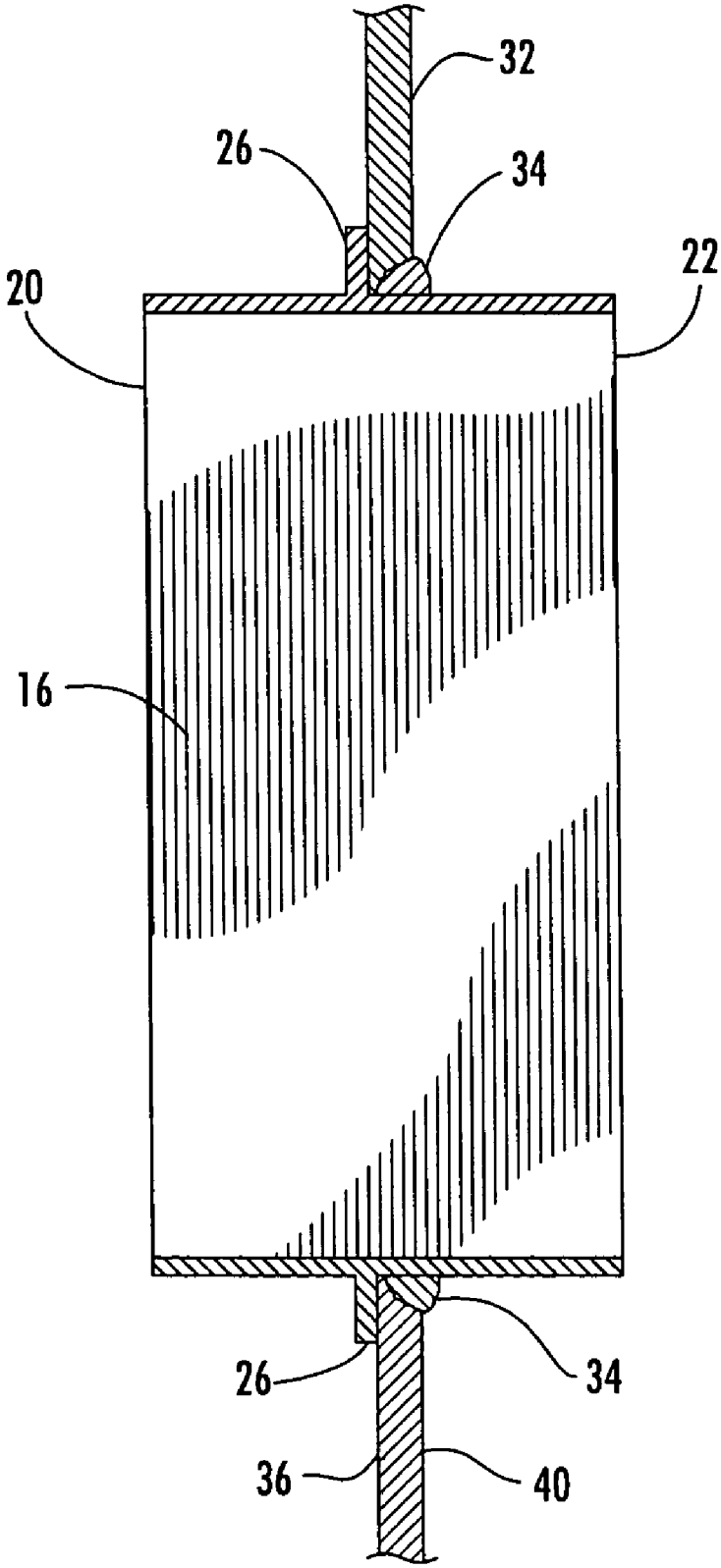
FIG. 4 is a cross-sectional view of the porthole installed in the crude opening of the monopole.

Referring now to FIGS. 1–4, wherein like elements are numbered consistently throughout, FIG. 1 illustrates a rectangular metallic device (i.e., porthole) 10 for providing access and structural integrity to a crude opening formed within the wall of a communication antenna supporting structure 32, including, albeit not limited to a monopole (FIG. 4). The device is defined by first and second penetrating end walls 12, 14, and first and second penetrating side walls 16, 18. The device includes an inner edge 20 and outer edge 22 with an aperture 24 located therebetween. The perimeter distance of the penetrating walls 12, 14, 16, and 18 is approximate to and less than the crude opening created and is adapted for insertion along the axis of penetration.

The metallic device 10 is shown here with a backing bar 26 disposed perpendicularly to the first and second penetrating walls 12, 14, 16, 18. The backing bar 26 is constructed and arranged to be positioned in overlapping and juxtaposed relation to said crude opening. The penetrating walls and backing bar cooperate with the crude opening to enable formation of a complete joint penetration weld.

In a preferred embodiment, backing bar is integrally connected to the penetrating walls of the device by a weldment in compliance with AWS D1.1 code qualifications for weld joints.

Figure 2:
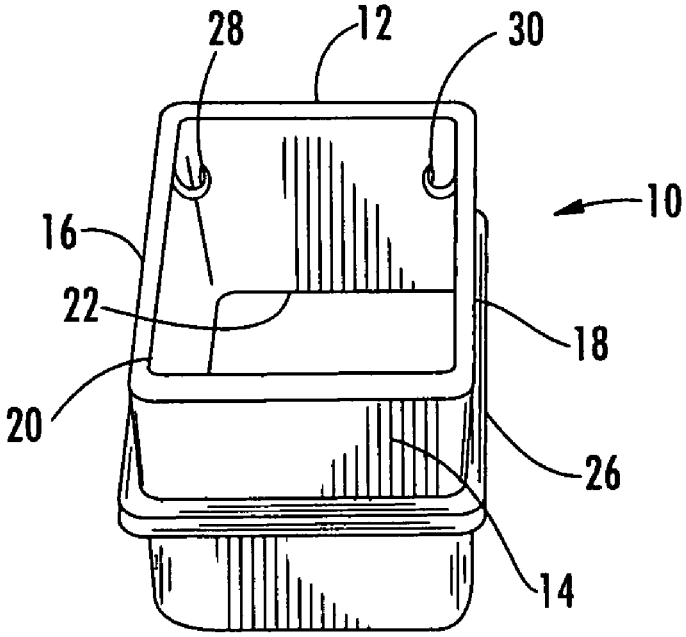
FIG. 2 is an elevated end perspective view of the porthole shown in FIG. 2.
Figure 3:
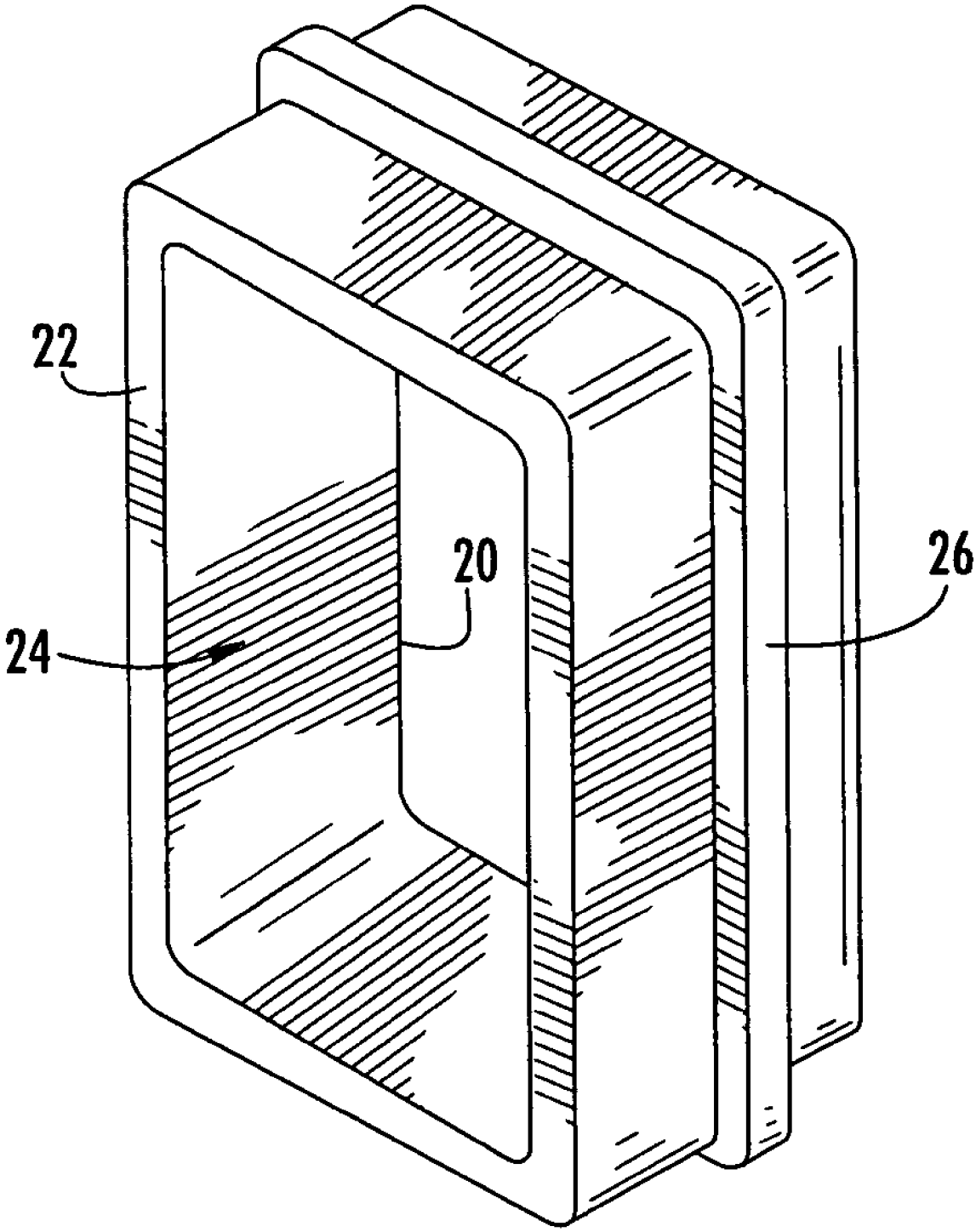
FIG. 3 is an opposite side perspective view of the porthole shown in FIGS. 1 and 2.

As illustrated in FIGS. 1 and 2, the device can further include at least one cable support means 28, 30 for guiding at least one communication cable therethrough. Although depicted herein as hooks it is hereby contemplated that other means of cable support capable of being used to channel wires or a wire harnesses through the porthole could be used without departing from the scope of the invention.

The instant metallic device 10 is installed into a crude metallic opening formed within a wall of a supporting structure 32 (FIG. 4) in accordance with the following exemplary method of installation.

In a preferred method, the interior of the supporting structure (i.e., monopole) is inspected by a remote camera that is inserted into the interior portion of said supporting structure through an existing porthole to determine whether the interior contains any debris (e.g., vegetation, animals, paper waste or like) which could pose a danger during the installation of the porthole.

Next, a worker will penetrate the exterior surface 40 of the supporting structure 32 preferably by a mechanical cutter having metal cutting blades attached to a reciprocating saw, drill or the like. Grinders with abrasive cutting blades, plamsa- and oxy-fuel torches may be used when deemed safe.

A metallic device 10 (i.e., porthole) including at least one crude metallic opening penetrating wall having dimensions approximate to and less than the crude metallic opening to allow for proper root opening for the selected weld joint will be provided for insertion along the axis of penetration. The porthole further includes at least one backing bar disposed perpendicularly to the penetrating wall.

Optionally, the appropriate attachment areas of the monopole, backing bar and porthole may be prepared by grinding or brushing to remove all galvanizing and surface contaminants which might contaminate the weld pool.

As shown in FIG. 4, the porthole is then inserted into the crude opening of the supporting structure and maneuvered by the worker, located at the exterior of the supporting structure, such that the outer edge 22 extends outwardly from the crude opening of the supporting structure and the backing bar 26 is overlapping and juxtaposed to the interior surface 36 of the supporting structure. This overlapping configuration allows for a complete joint penetration weldment 34 to be formed between the flange and supporting structure without the worker having to enter the monopole interior.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A metallic device useful for providing structural integrity to a crude metallic opening penetrating a wall of a communications supporting structure, said opening having an axis of penetration therethrough, said device comprising:

at least one crude opening penetrating wall having dimensions approximate to and less than said crude opening and adapted for insertion along said axis of penetration;

at least one backing bar disposed perpendicularly to said crude opening penetrating wall and constructed and arranged to be positioned in overlapping and juxtaposed relation to said crude opening;

wherein said crude opening penetrating wall and said backing bar cooperate with said crude metallic opening to enable formation of a complete joint penetration weld; wherein said porthole is integrally connected to said crude opening by a weldment in compliance with AWS D1.1 code qualifications for weld joints.

2. The device as set forth in claim 1, wherein said backing bar is positionable within said supporting structure in overlapping and juxtaposed relation to said crude opening.

3. The device as set forth in claim 1, wherein said device has an aperture formed along said axis of penetration.

4. The device as set forth in claim 3, wherein said device is a porthole constructed and arranged for receipt of at least one communication cable therethrough.

5. The device as set forth in claim 4, wherein said device further includes at least one cable support means for guiding said at least one communication cable therethrough.

6. A communication antenna supporting structure assembly comprising:

a communication antenna supporting structure including a crude metallic opening;

a porthole useful for providing structural integrity to a crude metallic opening, said porthole including at least one crude opening penetrating wall having dimensions approximate to and less than said crude opening and adapted for insertion along said axis of penetration;

at least one backing bar integrally connected and perpendicularly disposed about said crude opening penetrating wall and constructed and arranged to be positioned in overlapping and juxtaposed relation to said crude opening;

wherein said porthole and said backing bar cooperate with said crude metallic opening to enable formation of a complete joint penetration weld;

wherein said backing bar is integrally connected to said crude opening penetrating wall by a weldment in compliance with AWS D1.1 code qualifications for weld joints.

7. A method of installing a porthole into a crude metallic opening formed within a wall of a supporting structure to provide an access to an interior portion thereof, said crude opening having an axis of penetration, comprising the steps of:

I) forming said crude metallic opening in said supporting structure by a mechanical cutter;

ii) providing a porthole having at least one crude metallic opening penetrating wall having dimensions approximate to and less than said crude metallic opening and adapted for insertion along said axis of penetration, said porthole further including at least one backing bar disposed perpendicularly to said opening penetrating wall;

iii) inserting said porthole into said crude opening wherein said backing bar is positioned in overlapping and juxtaposed relation to said crude opening; and iv) forming a complete joint penetration weldment between said flange and said supporting structure.

* * * * *